US006739741B2

(12) United States Patent
Awa

(10) Patent No.: US 6,739,741 B2
(45) Date of Patent: May 25, 2004

(54) DISPLAY DEVICE BY COLUMNAR LIGHT

(75) Inventor: Yoshihiko Awa, Hokkaido (JP)

(73) Assignee: APT Co., Ltd., Hokkaido (JP)

( * ) Notice: Subject to any disclaimer, the term of this patent is extended or adjusted under 35 U.S.C. 154(b) by 0 days.

(21) Appl. No.: 10/255,001

(22) Filed: Sep. 26, 2002

(65) Prior Publication Data

US 2004/0062049 A1 Apr. 1, 2004

(51) Int. Cl.[7] ..... F21V 21/10; F21V 7/20; F21V 23/02

(52) U.S. Cl. ..... 362/431; 362/145; 362/263; 362/276; 362/345

(58) Field of Search ..... 362/145, 153.1, 362/218, 263–265, 276, 293–294, 345, 802

(56) References Cited

U.S. PATENT DOCUMENTS 3,940,606 A * 2/1976 Lemons ..... 362/263
4,882,667 A * 11/1989 Skegin ..... 362/373
5,450,302 A * 9/1995 Maase et al. ..... 362/276
5,941,632 A * 8/1999 Wedell et al. ..... 362/265
6,563,255 B1 * 5/2003 Collins ..... 362/296

* cited by examiner

*Primary Examiner*—Alan Cariaso
(74) *Attorney, Agent, or Firm*—Reed Smith LLP; Stanley P. Fisher, Esq.; Juan Carlos A.Marquez, Esq.

(57) ABSTRACT

A display system comprising a high-intensity discharge lamp system equipped with a stabilizer, a reflector mirror coated with a heat-absorption film, a shutter, and a light-gathering lens; and a pole holding the high-intensity discharge lamp system at a desired height above the road or its vicinity. The display system of the invention enables drivers to easily see and locate the centerline, road shoulder, crosswalk, and traffic signs, even in the midst of rainstorm, dense fog, or blizzard.

8 Claims, 10 Drawing Sheets

DISPLAY DEVICE BY COLUMNAR LIGHT

TECHNICAL FIELD

The invention relates to a display device that can alert vehicle drivers to the presence of a road shoulder, crosswalk, road boundary, traffic signs, and other traffic safety assistants, particularly under conditions such as heavy rain, fog, snow, or nighttime darkness that typically impair driver visibility.

BACKGROUND OF THE INVENTION

For example, in the event of a thick fog, the driver may be unable to see a road shoulder or centerline. Similar problems with visibility are encountered in heavy rain or snow.

A typical solution to such problems is to separate the sidewalk from the roadway by slightly raising the sidewalk from the level of the roadway and to install a guard rail at the boundary to protect pedestrians.

In efforts to curb the recent increase in such traffic, accidents, a reflector plate, for example, is installed at the turning point of the road to reflect light incident thereon at a specific angle and to alert drivers and pedestrians to the need for added caution to ensure traffic safety. In places where the sidewalk is not separated from the roadway, a visible sign called the arrow mark is installed above the road, one of many steps taken to increase traffic safety.

However, such reflectors cannot reflect sufficient light to be easily spotted by drivers or pedestrians during nighttime hours or during rain, times when traffic safety is especially important. In addition, such reflectors can be buried in snow and rendered invisible. Steps between the roadway and sidewalk, and even the guard rails themselves, are often hard to spot during thick fog or heavy rain.

One aspect of the present invention is to provide a display device capable of indicating to car drivers the presence and position of the centerline, road shoulder, crosswalk, and other traffic signs, even in rain, thick fog, or heavy snow.

SUMMARY OF THE INVENTION

The present invention is a display device using columnar light, comprising a high-intensity discharge lamp equipped with a stabilizer, a reflector mirror coated with a heat-absorption film, a shutter, and a light-gathering lens; and a pole holding the high-intensity discharge lamp at a desired height above the road or its vicinity, wherein the shutter is placed at the primary focal point of the high-intensity discharge lamp, and the light choked by the shutter is gathered by the lens to illuminate the road or its vicinity. The shutter is placed at the primary focal point of the high-intensity discharge lamp, and the lens gathers the light choked by the shutter to illuminate the road or its vicinity.

In the invention, the above poles, each capable of emitting light from a high-intensity discharge lamp onto target spots, are installed on road shoulders, at boundaries between sidewalks and roadways, at crosswalks, at railroad crossings, and at sharp turns on mountain roads, where special attention to traffic safety is required. The light signs highlight areas that must remain visible to drivers. The invention employs a high-intensity discharge lamp, called an HID. HID lamps were developed to overcome conventional problems with light-emitting diodes and common laser lights, the light produced by which is weaker than headlights and is thus often obscured or drowned out in times of low visibility. Following intensive research and development efforts, a high-intensity discharge lamp has been developed that can emit light of an intensity greater than headlights.

Specifically, the illumination intensity of most vehicle headlights is 40,000 candela (cd) during normal conditions, while that of the center of the developed high-intensity discharge lamp reaches 50,000–1,000,000 candela (cd). This is one of the features of the present invention. Such high illumination intensity is provided by employing a high-intensity discharge lamp in combination with a reflector mirror coated with heat-absorption film, a shutter installed at the primary focal point of the lamp, and a lens that concentrates the light choked and amplified by the shutter.

The high-intensity discharge lamp can function at a voltage of 100 or 200V. As another feature of the invention, the lamp is equipped with: a sensor sensitive to light intensity or weather conditions, with an on/off switch operated manually or by the sensor. The lamp is capable of being set to switch off during times when there is no need for illumination.

When the present invention is employed as a safety sign in a crosswalk, high-intensity light beams are emitted across the road along both sides of the crosswalk. Thus, even when the crosswalk is not clearly visible, because covered by snow or for any other reason, such light beams or other signs remain visible above the crosswalk, indicating the presence and position of the crosswalk to drivers and pedestrians.

Particularly in the case of snow or dense fog, the light from the high-intensity discharge lamp is randomly reflected by snow flakes or raindrops above the road, forming a light plane. This significantly enhances visibility. In addition, the lighting thus produced is remarkably pleasing to the eye.

DETAILED DESCRIPTION OF THE PREFERRED EMBODIMENTS

The invention can emit a focused columnar light beam with an intensity of 50,000 to 1,000,000 candela, bright enough to be visible even when simultaneously lit by ordinary car headlights of an intensity of 40,000 candela.

Figure 16:
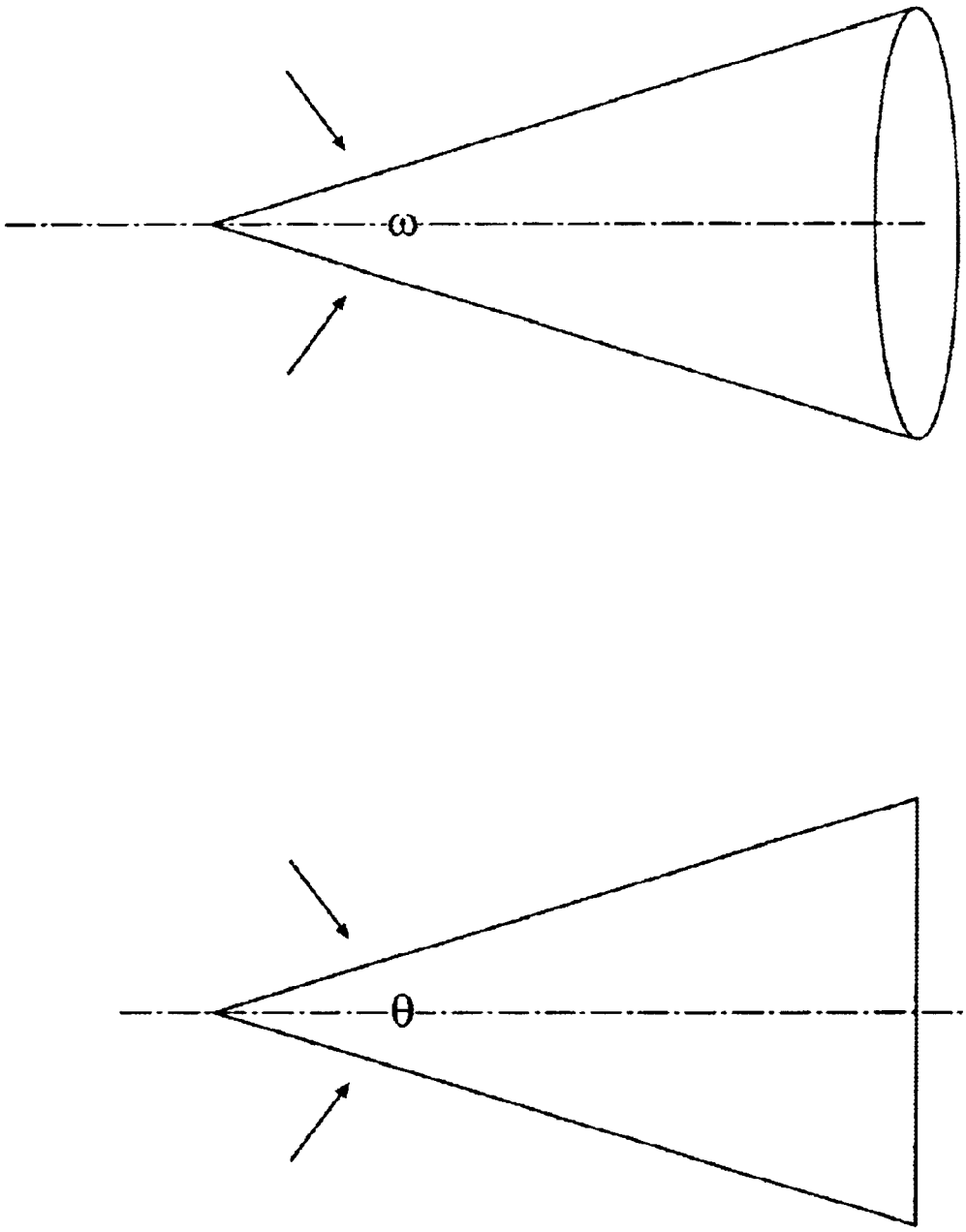
FIG. 16 is a diagram illustrating the relationship between the light plane angle θ and solid angle ω of the area illuminated by the high-intensity discharge lamp.

One candela is defined as 1 lm/sr (light flux of 1 lm over a solid angle of 1 steradian). An ideal point light source of one candela emits a light flux of 4π lm at all solid angles, calculated as follows:

$$\text{All solid angles}(=4\pi^{sr})\times 1^{lm/sr}=4\pi^{lm},$$

where π is the circular constant (π=3.14159); the unit in this case is the Steradian. Thus, 4π (=12.566) corresponds to 360°, equal to 2π (radian) in two-dimensional angles. A one candela point light source emits light in all directions (4π in the solid angle); and the light flux representing the amount of light is 4πlm. The relationship between the plane angle θ and solid angle ω is shown in FIG. 16, where $\omega=2\pi\{(1-\cos\theta/2\}$.

Light intensity is considered to be the total quantity of light of various wavelengths, or an assembly of the energy distribution following Planck's law of radiation from the perfect black body. An ideal one candela point light source illuminates a spot at a distance of 1 m with alight intensity of one Lux (The area enclosed by a solid angle of one Steradian is 1 $m^2$ in a sphere having radius 1 m).

A solid angle is defined as the surface area of a unit sphere coinciding with the surface's projection onto the sphere, while the plane angle θ is the corresponding two-dimensional angle. The solid angle ω is expressed by $2\pi\{1-\cos\theta/2\}$.

Following intensive research, we have found that high-intensity discharge lamps are the optimal choice for achieving the desired brightness (illumination intensity).

High-intensity discharge lamps include high-pressure sodium lamps, metal-halide lamps, and mercury lamps, and are usually called HID lamps. Although the sealed elements and component materials vary depending on lamp type, their basic structure and operating principles are virtually identical. Namely, they have a hard-glass outer tube housing a quartz arc tube and a metal component that holds the arc tube and provides electric power.

The arc tube has electrodes at both ends for electric discharge, and contains mercury (Hg) and Ar gas as luminous materials. The nitrogen gas sealed in the outer glass tube prevents oxidation of the metallic component at the high temperatures generated by the are tube during operations. The electric discharge between the two electrodes in the arc tube causes mercury atoms to emit light.

In metal-halide lamps, metal halides of sodium (Na) and scandium (Sc) are sealed in as luminous materials in addition to Hg in order to provide a wide range of illumination spectra of metal elements. The metal-halide lamp holds sodium sealed under high pressure and employs a transparent alumina, instead of quartz glass, that can hold high-temperature sodium vapor.

In principle, electrons emitted from an electrode collide with Hg atoms while traveling to the opposite electrode. Due to the high density and temperature of Hg atoms, the illumination spectrum expands over a wide wavelength range. The HID lamp, which can emit visible light with high densities of HG atoms and high temperatures, is an essential component of the, invention.

Figure 2:
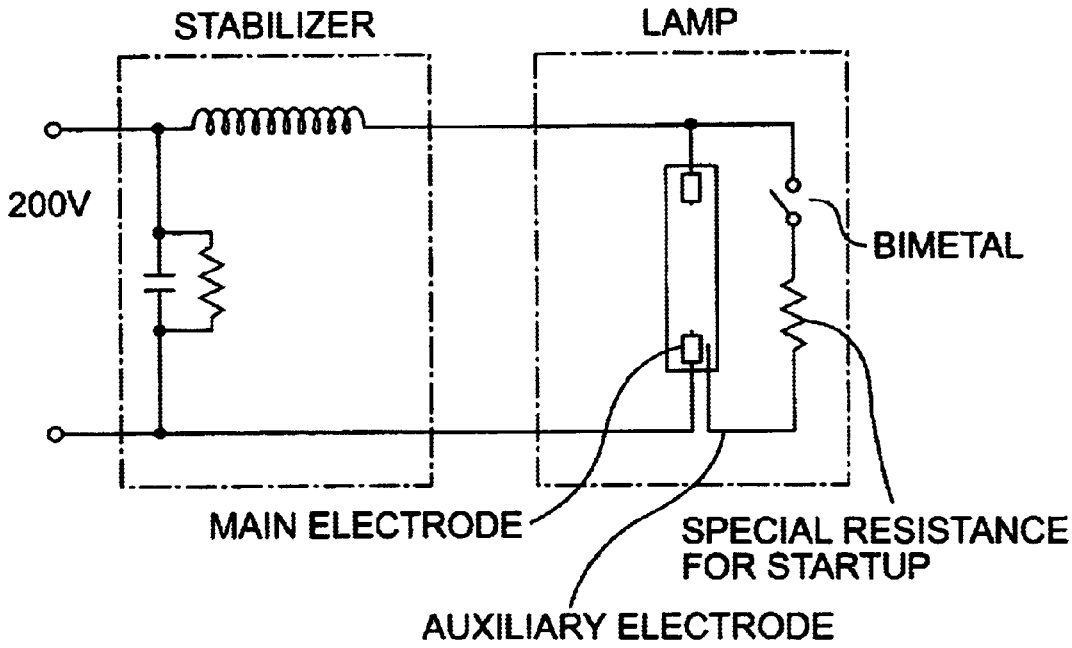
FIG. 2 is an illustrative diagram of the high-intensity discharge lamp installed in the high-intensity discharge lamp system.

A stabilizer is required to turn on a high-intensity discharge lamp, while mercury lamps incorporating a filament (chokeless mercury lamp) do not require stabilizers. FIG. 2 shows a typical startup circuit, which uses an auxiliary electrode. In this case, a weak discharge generated upon switch-on between the main electrode and the auxiliary electrode triggers the main discharge between the main electrodes. This is a technique most often used in mercury lamps. Alternately, when installing auxiliary electrodes or obtaining the desired results is difficult, another technique involves running a short high-voltage pulse current between the main electrodes or between the main and auxiliary electrodes.

Figure 3:
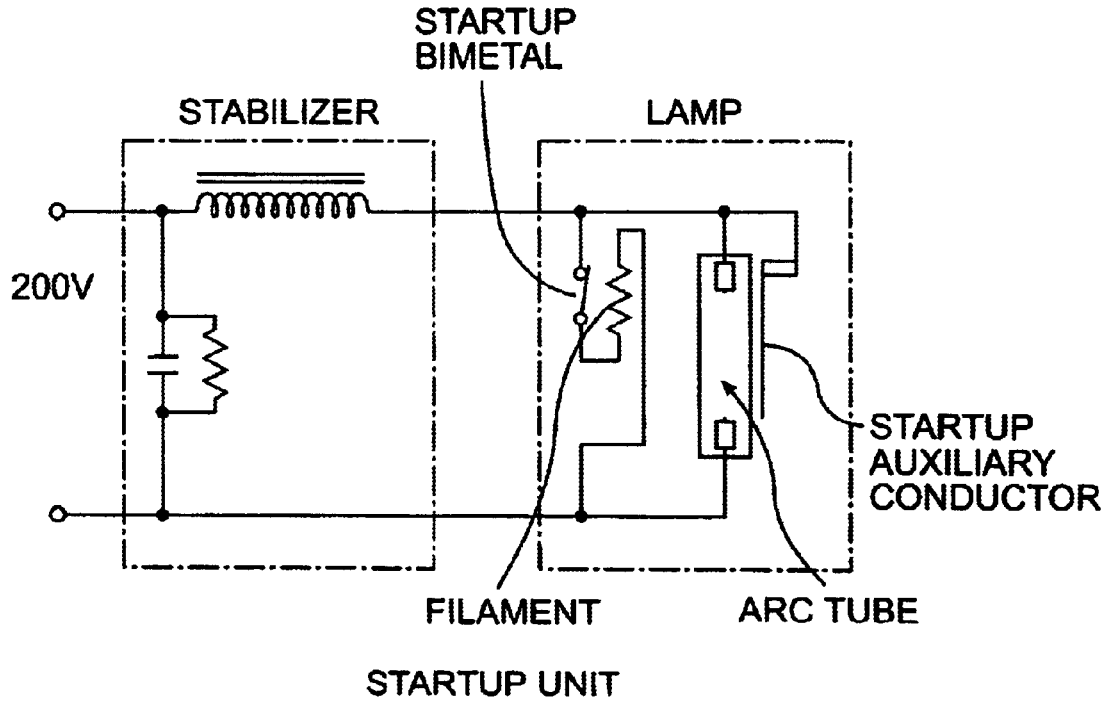
FIG. 3 is another illustrative diagram of the high-intensity discharge lamp installed in the high-intensity discharge lamp system.

A pulse generator is installed within the lamp or stabilizer. Some startup units incorporating a pulse generator have a startup bimetal and a filament in addition to the arc tube, as shown in FIG. 3. This technique is employed with metal-halide lamps and high-pressure sodium lamps.

High-pressure sodium lamps provide the highest illumination efficiency (obtained light flux per 1W) among high-intensity discharge lamps, followed by metal-halide lamps, then mercury lamps. The efficiency of high-pressure sodium lamps is about 2.4 while that of metal-halide lamps is about 1.4, compared to the reference unity of mercury lamps.

High-pressure sodium lamps having improved rendering-performance have lower efficiency than common high-pressure sodium lamps. Likewise, easy-to-use mercury lamps without a stabilizer (chokeless mercury lamp) provide lower efficiency than common mercury lamps.

In terms of color temperature (light color) and color rendition of high-intensity discharge lamps, a number of combinations are possible, depending on the intended application. For example, mercury lamps (fluorescent mercury lamps) emit pinkish white light of 3900K, metal-halide lamps (neo-ark beam) emit yellowish white light of 3500K, high-pressure sodium lamps (neo-look) emit warm golden-white light of 2100K, and high-rendition high-pressure sodium lamps (neo-color) emit yellowish light of 2500K, similar to that emitted by an incandescent lamp.

In terms of color rendering, metal-halide lamps are the optimal choice. Common high-pressure sodium lamps are inferior to metal-halide lamps. However, some high-pressure sodium lamps offer improved or enhanced color rendition.

Figure 4:
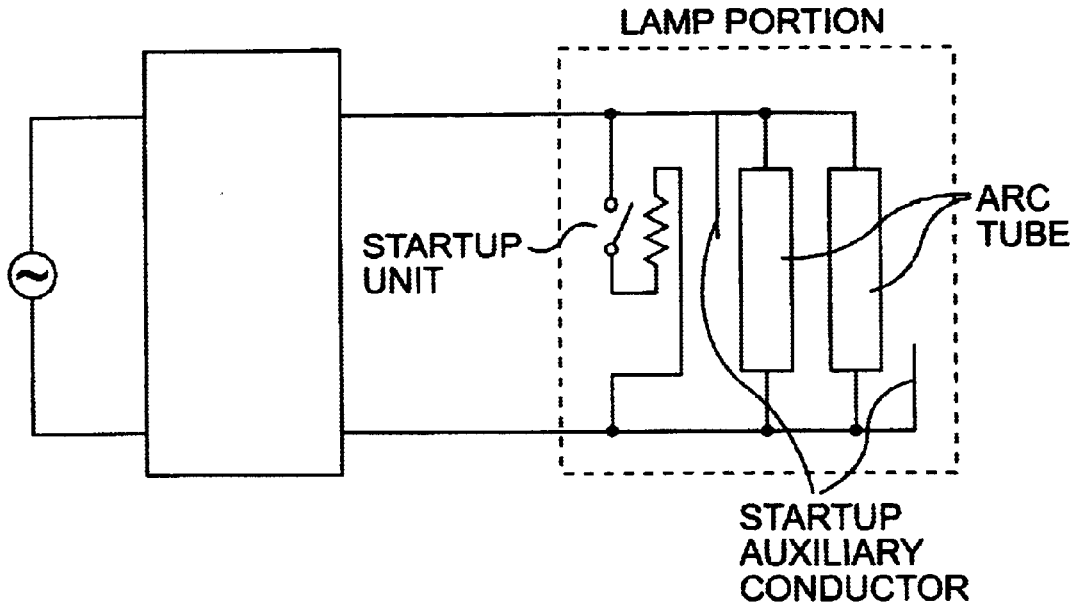
FIG. 4 is another illustrative diagram of the high-intensity discharge lamp installed in the high-intensity discharge lamp system.

On the other hand, a twin arc-tube high-pressure sodium lamp has been developed that has two arc tubes, as shown in FIG. 4, with each tube illuminating alternately for almost equal durations during each session. Some experiments have shown that the twin-lamp type lasts almost twice as long as conventional types. Indeed, this lamp may be lit with a mercury stabilizer (common low starter current type), and has a nominal life of up to 24,000 hours. This is because the lamp incorporates a startup auxiliary conductor of unique structure, and because the two arc tubes are lit for roughly the same intervals during the service life of the lamp, being started by a starter, in combination with a suitable stabilizer that generates positive/negative pulses corresponding to phase changes in the power supply.

Figure 5:
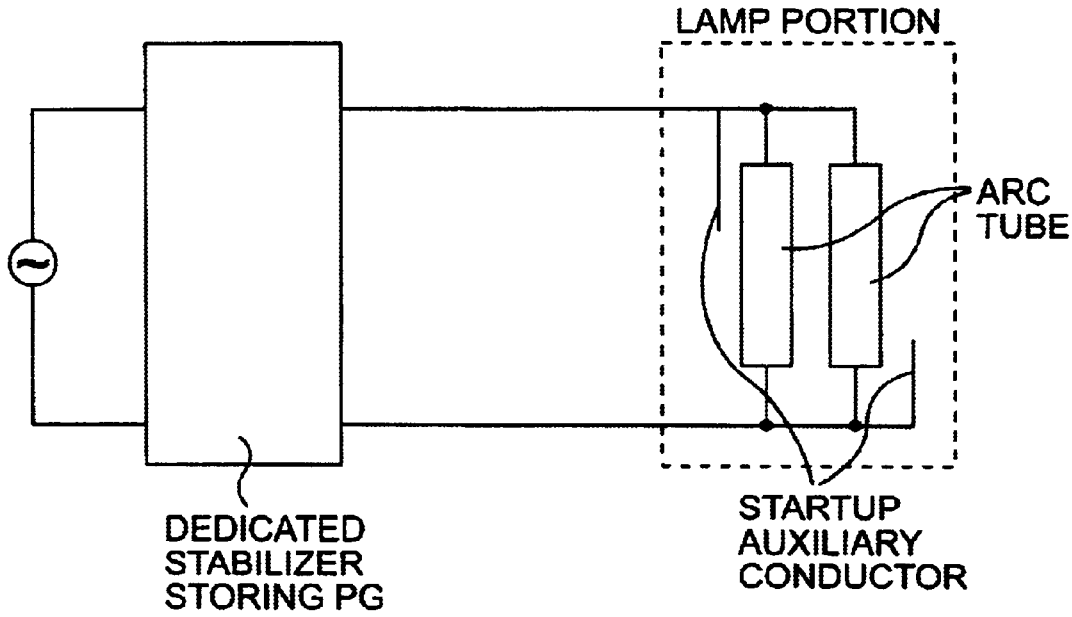
FIG. 5 is another illustrative diagram of the high-intensity discharge lamp installed in the high-intensity discharge lamp system.
Figure 6:
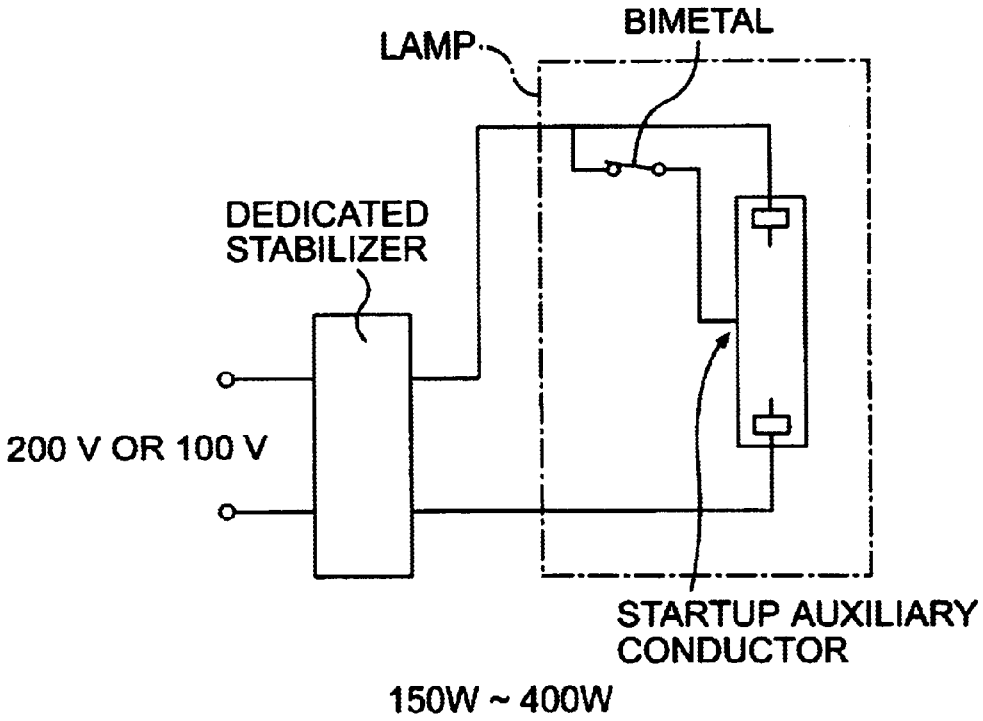
FIG. 6 is another illustrative diagram of the high-intensity discharge lamp installed in the high-intensity discharge lamp system.
Figure 7:
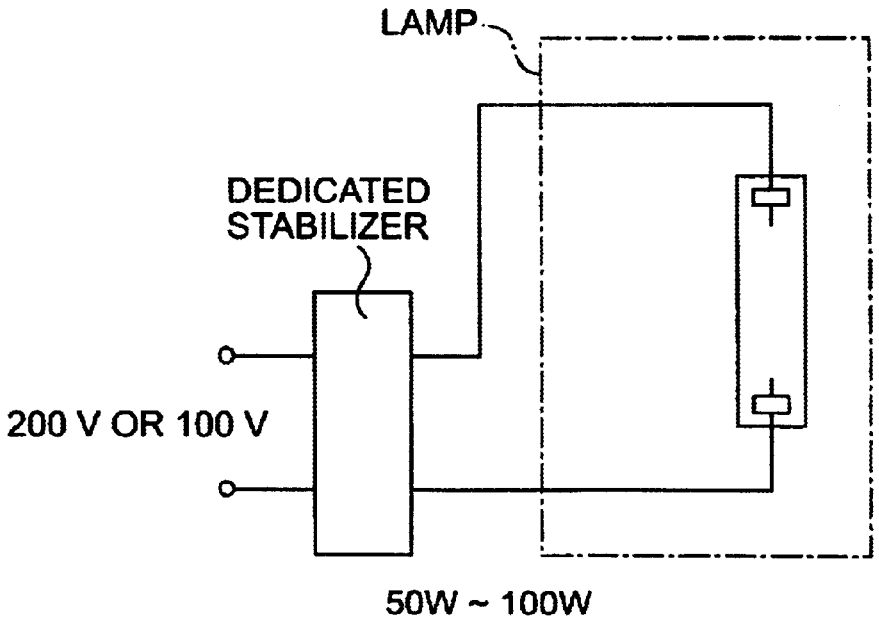
FIG. 7 is another illustrative diagram of the high-intensity discharge lamp installed in the high-intensity discharge lamp system.

Another type high-pressure sodium lamp is available in which the twin arc tubes illuminate alternately at an efficiency much higher than that of the conventional neo-look lamp. Sodium lamps of this type have two arc tubes, as shown in FIG. 5, which are slightly displaced from each other to lower interactions. Additionally, this lamp is subject to a patented chemical polishing and contains high-pressure Xe, and is equipped with a dedicated stabilizer incorporating a control circuit that lights the tubes alternately upon power-on. Some high-rendition/high-chrominance high-pressure sodium lamps have the structure shown in FIGS. 6 and 7, in which a heat-resistant metal wire is wound around the arc tube to ensure lamp startup without high-voltage pulses. Such lamps employ a highly transparent alumina tube in its arc tube and a heat-resistant hard-glass outer tube in which a mixture of Na—Ne and Ar gases are enclosed. The interior of this glass tube is evacuated. Diffusion-type high-pressure sodium lamps have a coating of diffusion paint and the like on their inner surfaces, and emit light similar to that of incandescent lamps, with excellent color rendering effects. Both high-rendition and high-chrominance types are available. These are energy-saving light sources suitable for use in applications where the appearance of the color (color rendition) is important. Because they incorporate startup auxiliary conductors wound around the arc tube, they do not require high-voltage pulses and start without fail, even at voltages of 200V or less.

Another type of lamp also exists in which a startup unit having a startup bimetal and a filament is installed in the lamp. When power is supplied, the filament in the startup unit is heated, at which time the bimetal-switch opens and a voltage of about 3000V is induced between the ends of choke coil in the stabilizer. This pulse voltage combined with the source voltage is applied to the electrodes of the arc tube to cause discharging. Following startup, discharging is maintained by the source voltage, and the lamp remains continuously lit. The above range of high-intensity discharge lamps has been developed and is available for application to the present invention.

Figure 1:
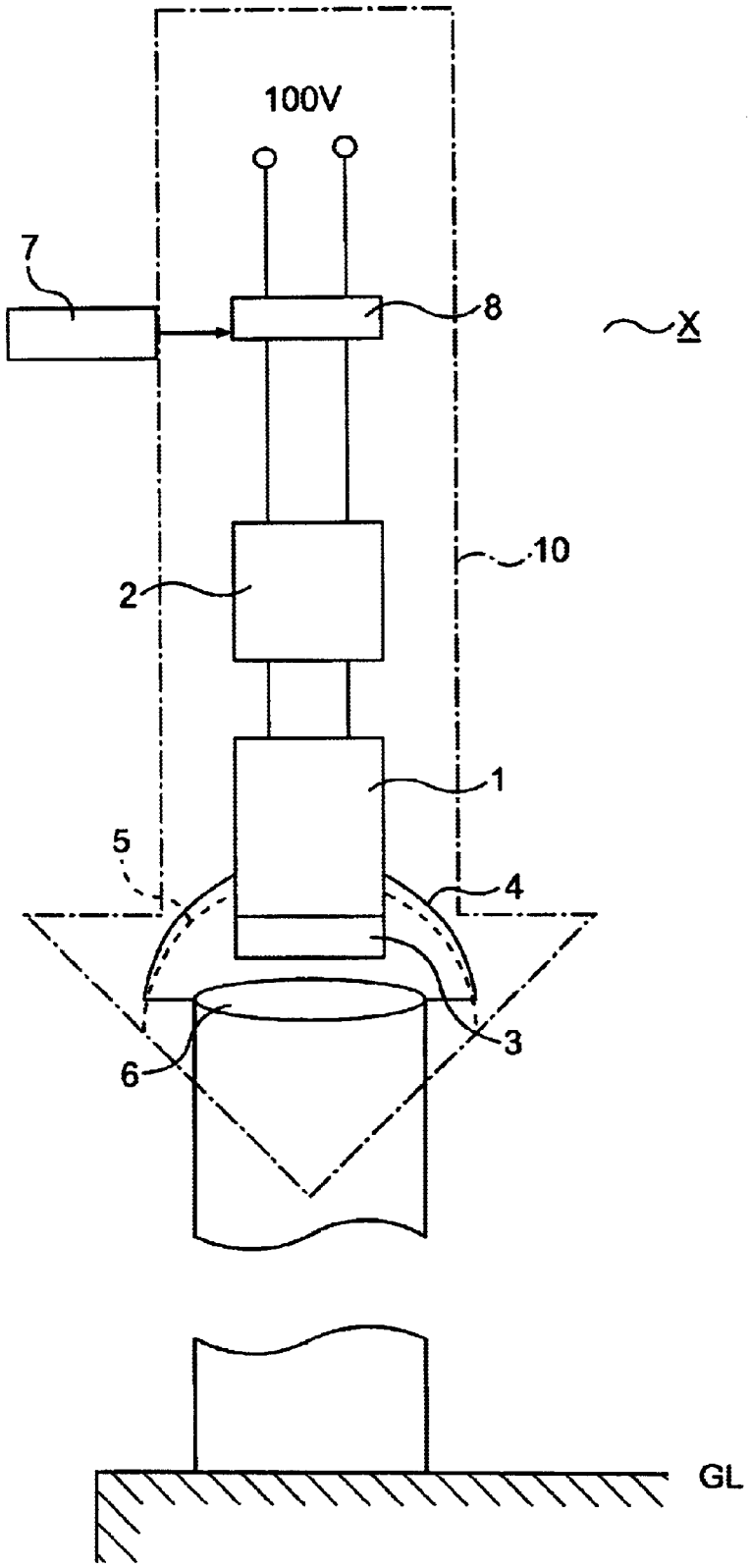
FIG. 1 is a schematic diagram illustrating the high-intensity discharge lamp system.

In FIG. 1, denoted (1) is a high-intensity discharge lamp equipped with a stabilizer(2), (3) is a shutter installed in the high-intensity discharge lamp (1), and (4) is an oval reflector mirror covering the back of the high-intensity discharge lamp (1) with a heat-absorption film (5) coated thereon. Denoted (6) is a light-gathering lens installed in front of the reflector mirror.

The high-intensity discharge lamp (1) is connected to a 100V power supply (not shown). In between the high-intensity discharge lamp (1) and power supply are installed a sensor (7) sensitive to, for example, light intensity, precipitation or weather conditions such as fog or snow, and a switch (8) coupled with this sensor. The high-intensity discharge lamp system (X) of the invention comprises those components.

Embodiment 1

Figure 8:
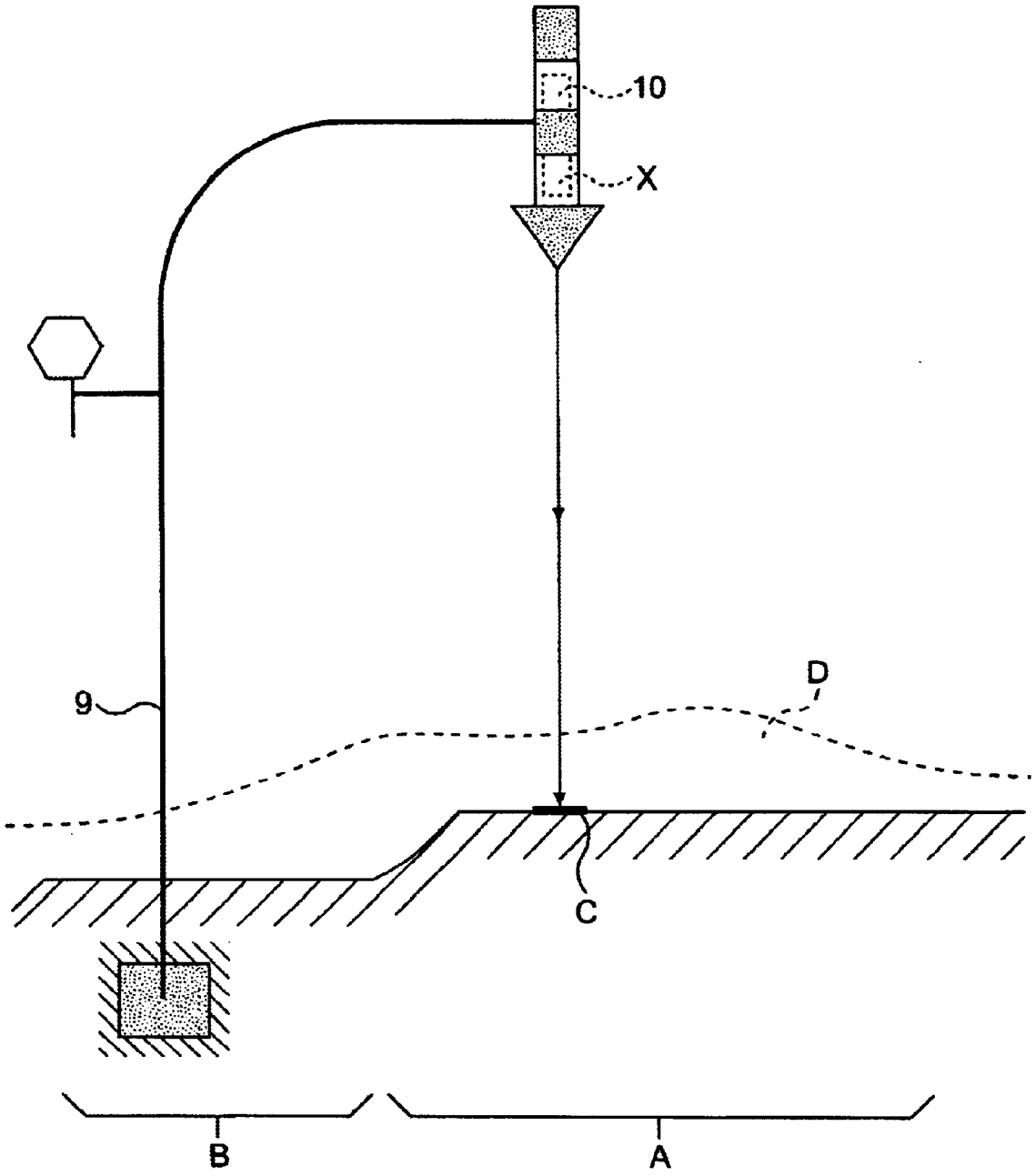
FIG. 8 is an illustrative diagram of the invention applied to a mountain road.

Now suppose that the high-intensity discharge lamp system (X) is installed on a mountain road having the roadway (A) and road shoulder (B) shown in FIG. 8. In the figure, denoted (9) is a pole standing on the shoulder (B), its top bent toward the roadway (A).

Figure 10:
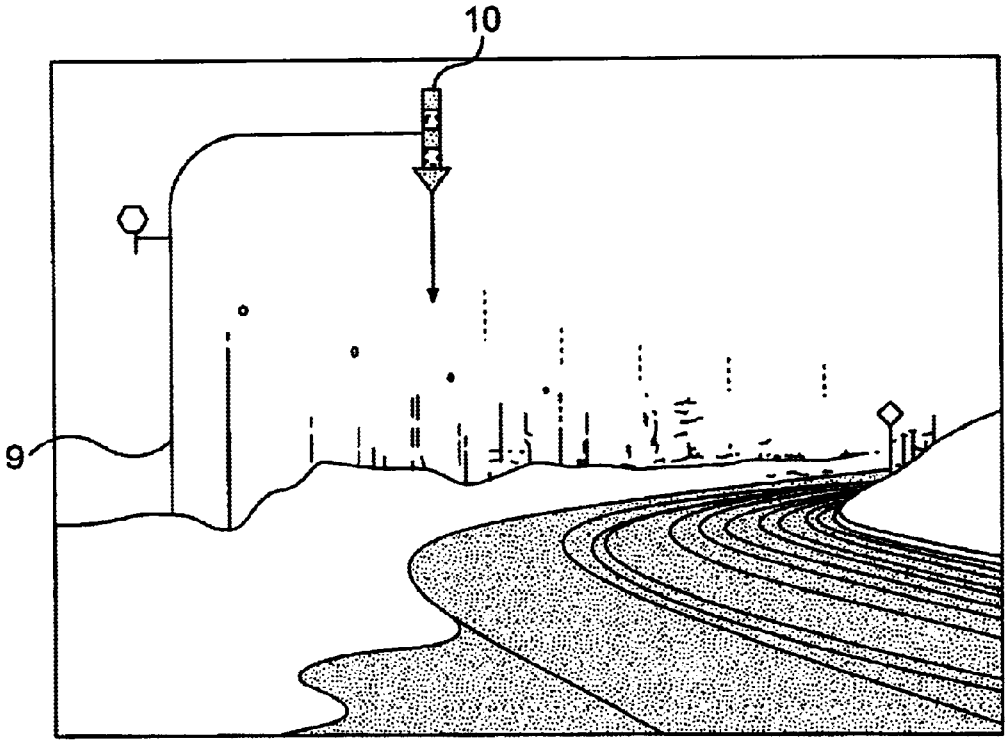
FIG. 10 is an illustrative diagram of a mountain road on a fine day with good visibility.
Figure 11:
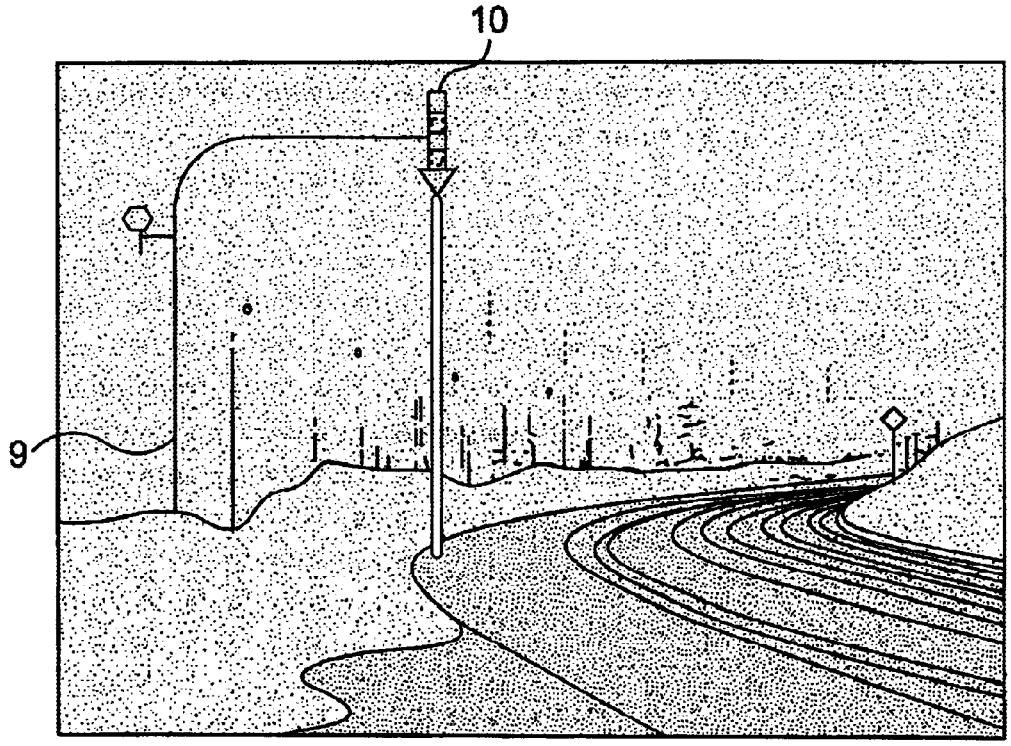
FIG. 11 is an illustrative diagram of the road from FIG. 10 during a blizzard.

Denoted (10) is a common arrow mark seen in many places, and attached to the end of the pole (9). This arrow mark is fixed to direct to the boundary (C) between the roadway (A) and shoulder (B). During daylight hours when nothing impedes driver visibility, drivers can safely operate cars on the roadway (A), as shown in FIG. 10, keeping the arrow mark in view as a reference point. On the other hand, when the arrow mark (10) is not visible, when blocked by thunderstorms, rain, or fog; or when snow (D) covers the boundary (C) between the roadway (A) and shoulder (B), poor visibility may lead to a car running off the roadway (A), or even beyond the shoulder (B), resulting in a serious traffic accident.

Figure 12:
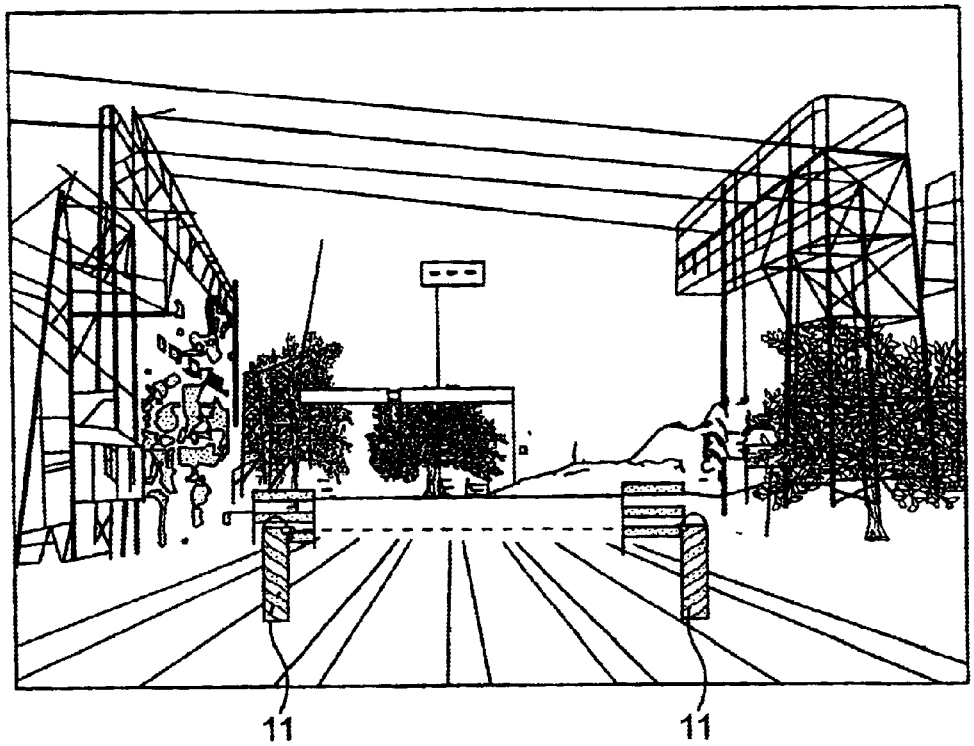
FIG. 12 is an illustrative diagram of a railroad crossing on a fine day with good visibility.

In this embodiment, the high-intensity discharge lamp system (X) is attached to the arrow mark (10). Suppose now that a car (Z) encounters a blizzard, as shown in FIG. 12, while operating on a roadway (A). Under such conditions, the switch (8) of the high-intensity discharge lamp (1) is already tuned on and the lamp emits light, since the sensor (7) installed in the high-intensity discharge lamp (1) has detected the blizzard. The generated light is choked by the shutter (3) to increase its intensity and is incident upon the oval reflector mirror (4). This light, collected by the lens (6) to form a columnar light beam, is directed upon the boundary (C). In this case, the intensity of this light beam can be as high as 1,000,000 candela, while the intensity of ordinary headlights is 40,000 candela. Thus, even if the area illuminated by the headlights of the vehicle (Z) overlaps that of the high-intensity discharge lamp (1), the area lit by the high-intensity discharge lamp (1) remains distinct, allowing the vehicle (Z) to operate on the roadway (A) with assured visibility.

Embodiment 2

Figure 13:
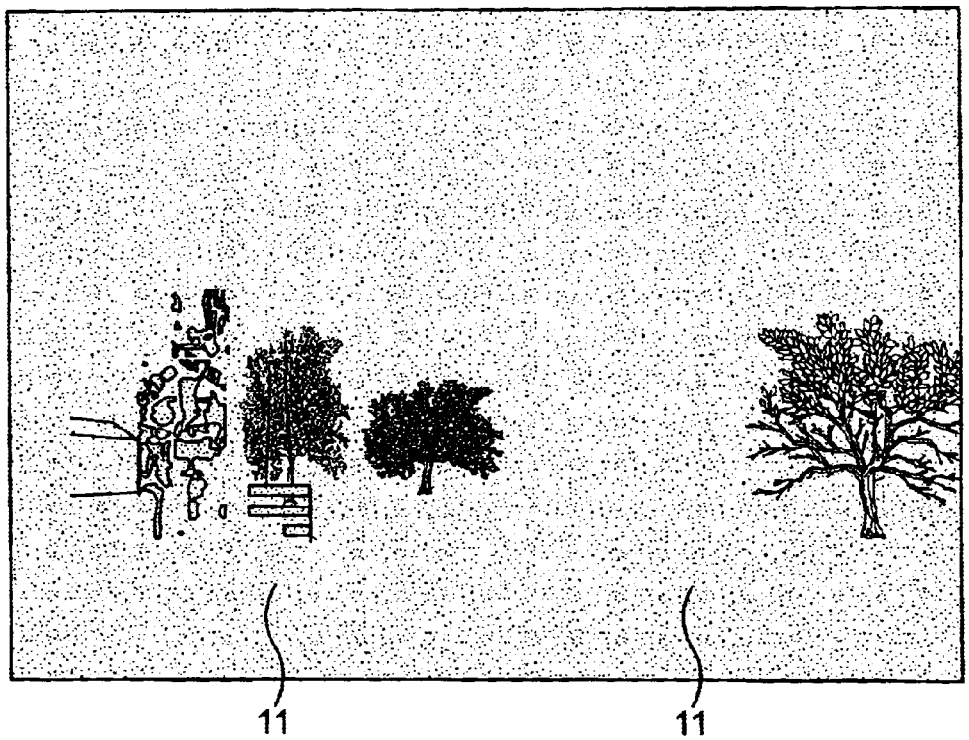
FIG. 13 is an illustrative diagram of the railroad from FIG. 12 during a blizzard.

FIGS. 12 and 13 show a railway crossing; FIG. 12 shows a scene during daylight hours of sufficient visibility; while FIG. 13 shows the same scene during a blizzard.

Figure 9:
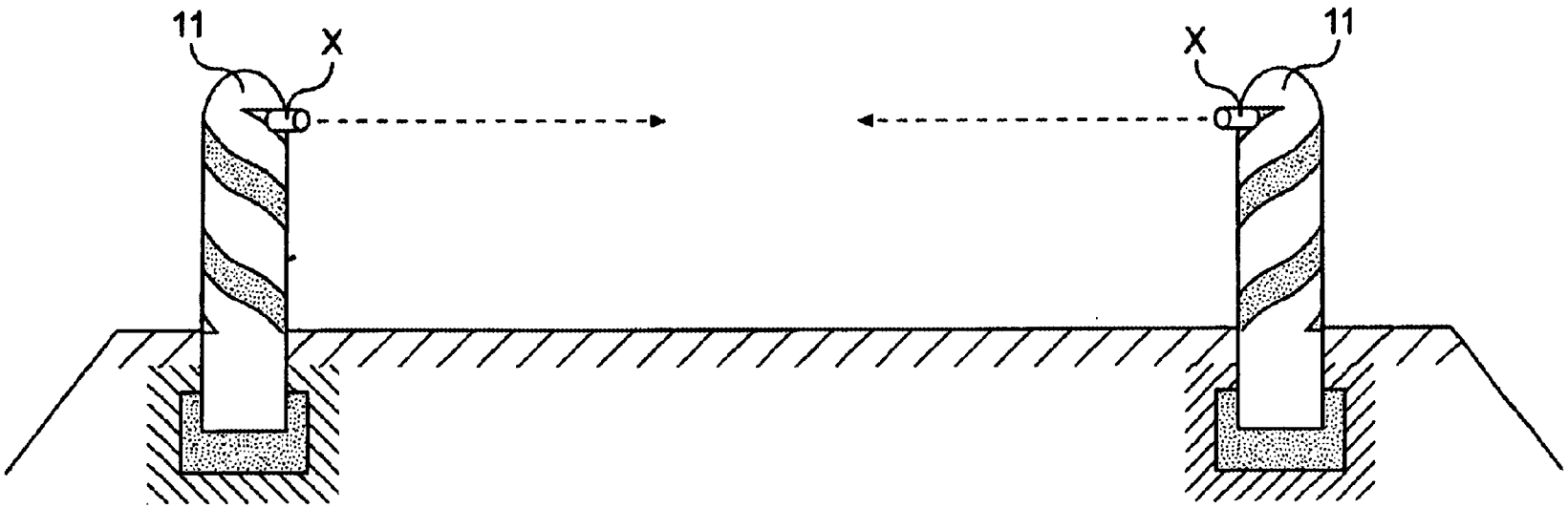
FIG. 9 is an illustrative diagram of the invention applied to a railroad crossing.

In this case, a pair of masts stand at both sides of the crossing or at both sides of the vehicle (Z) in front of the crossing, as shown in FIG. 9, at the tops of which the high-intensity discharge lamp systems (X) are installed. The high-intensity discharge lamps (1) emit light to each other. In this case, the switch (8) in each high intensity discharge lamp system (X) is controlled by the sensor (7) and operated in conjunction with the passage of trains or with the raising/lowering of the crossing bar.

Embodiment 3

Figure 14:
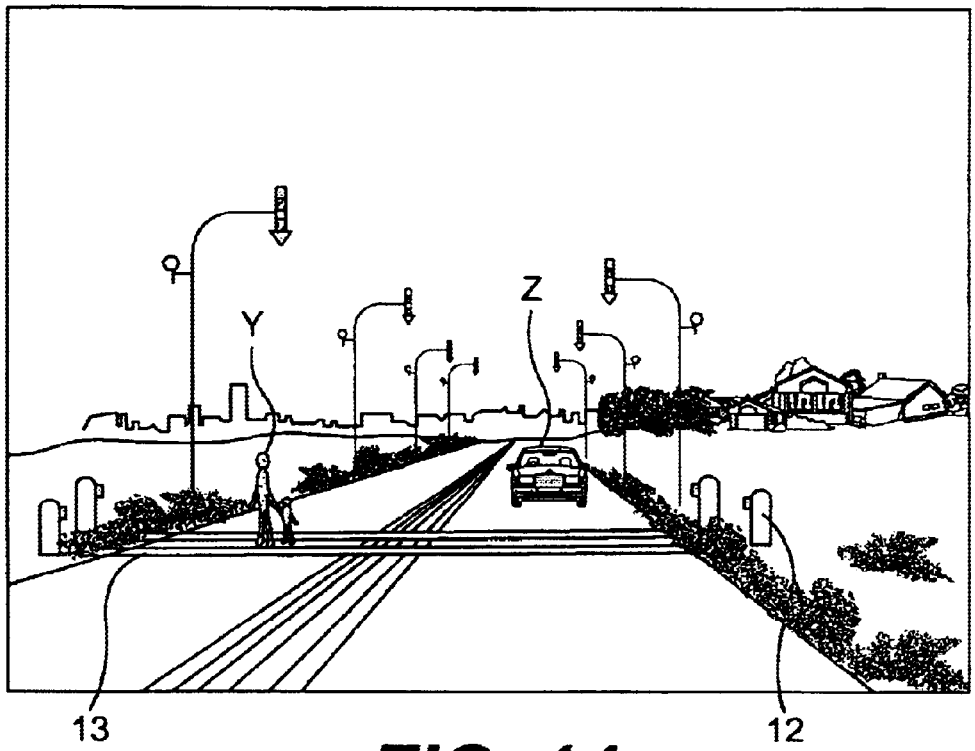
FIG. 14 is an illustrative diagram of a crosswalk on a fine day with good visibility.
Figure 15:
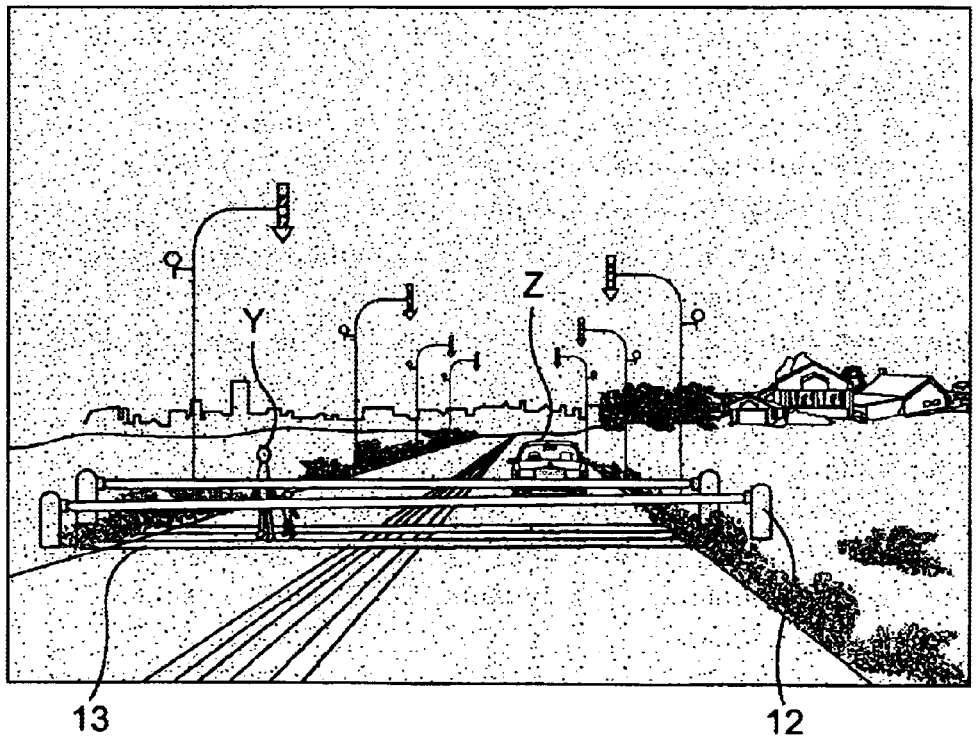
FIG. 15 is an illustrative diagram of the crosswalk from FIG. 14 during a blizzard.

FIGS. 14 and 15 show a crosswalk (13); FIG. 14 shows a scene of daylight hours of sufficient visibility; while FIG. 15 shows the same scene during a blizzard. In the embodiment of FIG. 15, four columns (12) are posted, each at the four corners of the crosswalk (13), at the tops of which the high-intensity discharge lamp systems (X) are mounted. In this case, the four columns (12) preferably stand vertically, perpendicular to the ground, and the high-intensity discharge lamps (1) of the high-intensity discharge lamp systems (X) emit light beams horizontally to the crosswalk (13).

During the actual use, when the traffic light for pedestrians is red, the high-intensity discharge lamp (1) of the high-intensity discharge lamp system (X) does not emit light. But when the traffic light for cars turns from green to red, the high-intensity discharge lamp (1) of the high-intensity discharge lamp system (X) emits a light beam horizontally, based on a signal sent from the traffic light, toward the high-intensity discharge lamp system (X) installed directly opposite the crosswalk (13). The light beams alert the driver of the vehicle (Z) as well as the pedestrian (Y) to the presence of the crosswalk (13), and indicates to the pedestrian (Y) that the traffic light is red for cars.

On the other hand, when the traffic light for pedestrians turns from green to red, the high-intensity discharge lamp (1) of the high-intensity discharge lamp system (X) shuts off the light, thereby alerting the pedestrian (Y) becomes aware that the traffic light for cars is green now.

Although not shown in the figure, the high-intensity discharge lamp (1) of the high-intensity discharge lamp system (X) can emit light beams in the direction parallel to the road (sidewalk) as well as the beams horizontally along the crosswalk (13), thereby indicating to the driver of the vehicle (Z) and pedestrian (Y) the current status of the traffic light.

In the present invention, the high-intensity discharge lamp system capable of emitting high-intensity light is installed on a mast standing on a road shoulder, between sidewalks and roadways, at crosswalks, at railroad crossings, and at sharp turns on mountain roads, where extra caution is required. The system ensures that vehicle drivers remain aware of such conditions even in thick fog, rainstorms, or snow.

In particular, the present invention employs a high-intensity discharge lamp, called an HID (High-intensity Discharge) lamp, capable of emitting powerful light. As a result of intensive research and development efforts, such HID lamp systems make it possible to overcome the typical problem associated with light-emitting diodes or common laser light, that the light is obscured by car headlights.

A: Roadway
B: Road shoulder
C: Boundary
D: Snowfall
X: High-intensity discharge lamp system
Y: Pedestrian
Z: Vehicle
1: High-intensity discharge lamp
2: Stabilizer
3: Shutter
4: Oval reflector mirror
5: Heat-absorption film
6: Light-gathering lens
7: Sensor
8: Switch
9: Pole
10: Arrow mark
11: Mast
12: Column
13: Crosswalk

What is claimed is:

1. A display device using columnar light comprising:

a high-intensity discharge lamp system equipped with a stabilizer, a reflector mirror coated with a heat-absorption film, a shutter, and a light-gathering lens; and a pole holding the high-intensity discharge lamp at a desired height above the road or its vicinity, wherein the shutter is placed at the primary focal point of the high-intensity discharge lamp, and the light choked by the shutter is gathered by the lens to illuminate the road or its vicinity.

2. The display device according to claim 1, wherein the light intensity in the center of the high-intensity discharge lamp is between 50,000 and 1,000,000 candela (cd).

3. The display device according to claim 1, wherein the high-intensity discharge lamp is equipped with a stabilizer, a reflector mirror coated with a heat-absorption film, a shutter, a high-gathering lens, a sensor sensitive to light intensity or weather conditions, and an On/Off switch driven manually or by said sensor.

4. The display device according to claim 1, wherein a plurality of poles each equipped with a high-intensity discharge lamp are installed at appropriate intervals in pairs facing each other within a predetermined area including the road shoulder, and the reach of the resulting light is limited by directing light from each high-intensity discharge lamp to the lamp opposite.

5. The display device according to claim 2, wherein the high-intensity discharge lamp is equipped with a stabilizer, a reflector mirror coated with a heat-absorption film, a shutter, a light-gathering lens, a sensor sensitive to light intensity or weather conditions, and an On/Off switch driven manually or by said sensor.

6. The display device according to claim 2, wherein a plurality of poles each equipped with a high-intensity discharge lamp are installed at appropriate intervals in pairs facing each other within a predetermined area including the road shoulder, and the reach of the resulting light is limited by directing light from each high-intensity discharge lamp to the lamp opposite.

7. The display device according to claim 3, wherein a plurality of poles each equipped with a high-intensity discharge lamp are installed at appropriate intervals in pairs facing each other within a predetermined area including the road shoulder, and the reach of the resulting light is limited by directing light from each high-intensity discharge lamp to the lamp opposite.

8. The display device according to claim 5, wherein a plurality of poles each equipped with a high-intensity discharge lamp are installed at appropriate intervals pairs facing each other within a predetermined area including the road shoulder, and the reach of the resulting light is limited by directing light from each high-intensity discharge lamp to the lamp opposite.

* * * * *